United States Patent [19]

Jamieson

[11] 4,365,570

[45] Dec. 28, 1982

[54] SAIL SYSTEM FOR SAILBOARDS

[76] Inventor: Robert S. Jamieson, 667 S. Hudson, Pasadena, Calif. 91106

[21] Appl. No.: 304,113

[22] Filed: Sep. 21, 1981

Related U.S. Application Data

[63] Continuation-in-part of Ser. No. 289,386, Aug. 3, 1981.

[51] Int. Cl.[3] ..... B63H 9/06

[52] U.S. Cl. ..... 114/39; 114/98; 114/102; 114/103; 114/108; 114/113

[58] Field of Search ..... 114/39, 102, 103, 108, 114/97, 98, 113; 244/130, 145, DIG. 1

[56] References Cited

U.S. PATENT DOCUMENTS

| | | | |
|---|---|---|---|
| 2,367,164 | 1/1945 | Yerger | 244/130 |
| 2,577,917 | 12/1951 | Root | 9/21 |
| 3,455,261 | 7/1969 | Perrin | 114/39 |
| 3,487,800 | 1/1970 | Schweitzer et al. | 114/39 |
| 3,874,816 | 4/1975 | Sweeney et al. | 416/139 |
| 3,996,868 | 12/1976 | Schagen | 114/39 |
| 4,100,870 | 7/1978 | Prade | 114/39 |
| 4,166,425 | 9/1979 | Kummetz | 114/39 |
| 4,253,209 | 3/1981 | Carn | 9/310 E |
| 4,261,276 | 4/1981 | Darzinskis | 114/104 |
| 4,263,861 | 4/1981 | Vicard | 114/39 |
| 4,269,133 | 5/1981 | Brown | 114/103 |
| 4,311,107 | 1/1982 | Imre | 114/39 |

FOREIGN PATENT DOCUMENTS

| | | | |
|---|---|---|---|
| 419990 | 10/1924 | Fed. Rep. of Germany | 114/102 |
| 2208999 | 4/1973 | Fed. Rep. of Germany | 244/145 |
| 7421380 | 12/1974 | Fed. Rep. of Germany . | |
| 7511522 | 8/1975 | Fed. Rep. of Germany . | |
| 2540759 | 3/1977 | Fed. Rep. of Germany . | |
| 2702642 | 8/1978 | Fed. Rep. of Germany . | |
| 2712018 | 9/1978 | Fed. Rep. of Germany . | |
| 2802340 | 7/1979 | Fed. Rep. of Germany | 114/39 |
| 2831766 | 1/1980 | Fed. Rep. of Germany | 114/103 |
| 2916643 | 11/1980 | Fed. Rep. of Germany . | |
| 984449 | 2/1951 | France | 114/102 |

OTHER PUBLICATIONS

Article from Popular Science Magazine entitled "Sailboarding: Exciting New Water Sport", by S. Newman Darby, Aug. 1965, vol. 187, pp. 138–141.

*Primary Examiner*—Charles E. Frankfort
*Assistant Examiner*—Thomas J. Brahan
*Attorney, Agent, or Firm*—Gausewitz, Carr, Rothenberg & Edwards

[57] ABSTRACT

In accordance with one aspect of the disclosure, the sail portion of a sailboard has upper and lower sections, and the lower edge (foot) of the upper section is lapped relative to the upper edge (head) of the lower section. Apparatus is provided to cause the lower edge to be on the upwind side of the upper edge, regardless of the tack that the boat is on. Such apparatus comprises a rotating boom which rotates through the sail, in such manner as to shift from one side of the sail to the other and also cause the above-described lapped relationship to occur in either tack. The disclosure further relates to a combination of the sail system with the board, to the method of achieving the indicated lapped relationship and of rotating the boom, and to other important features.

53 Claims, 28 Drawing Figures

FIG. 1.
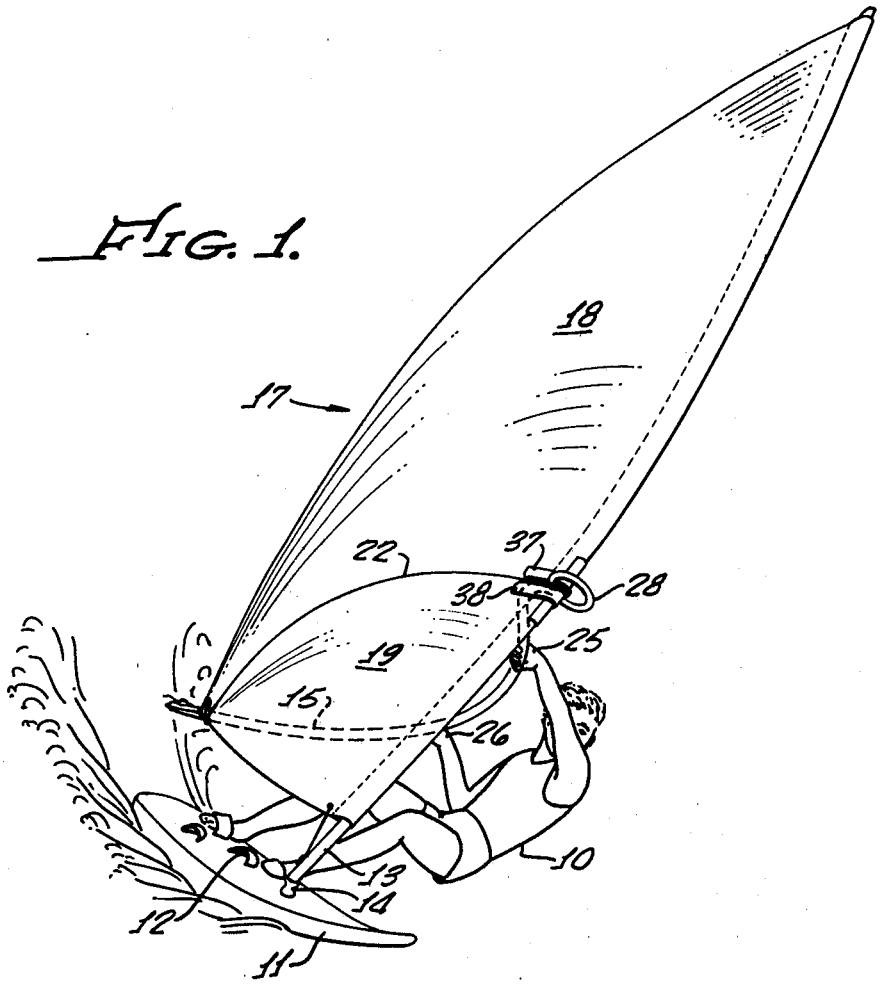
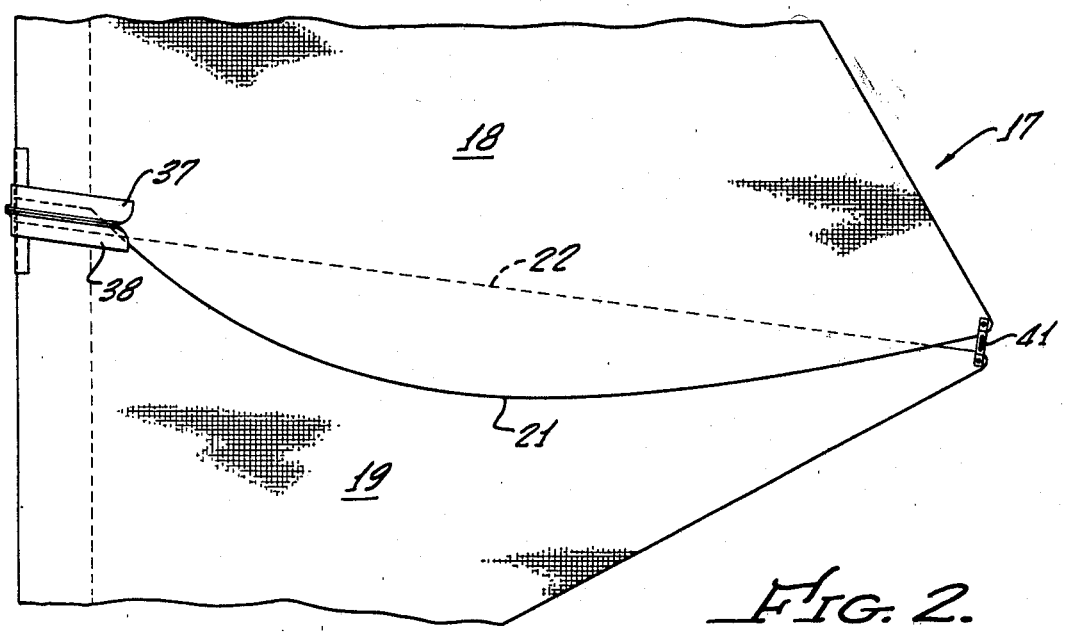
FIG. 2.

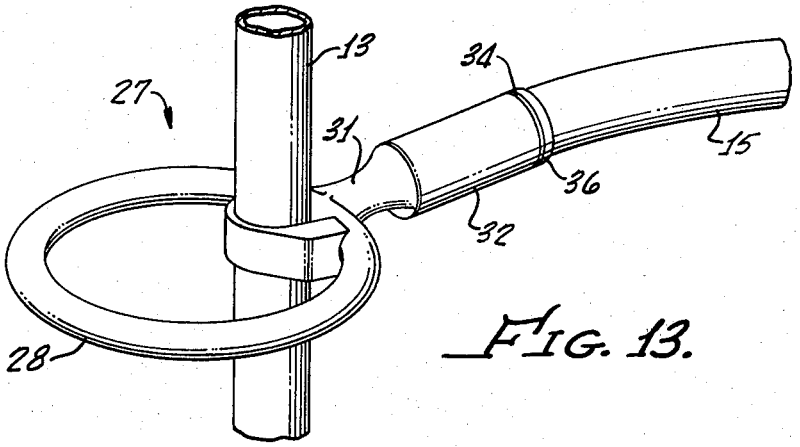
FIG. 13.
FIG. 14.
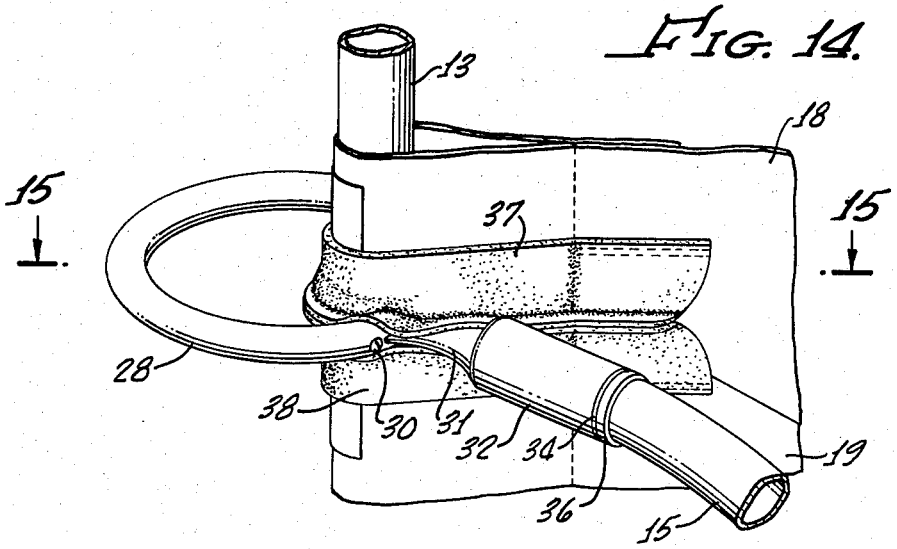
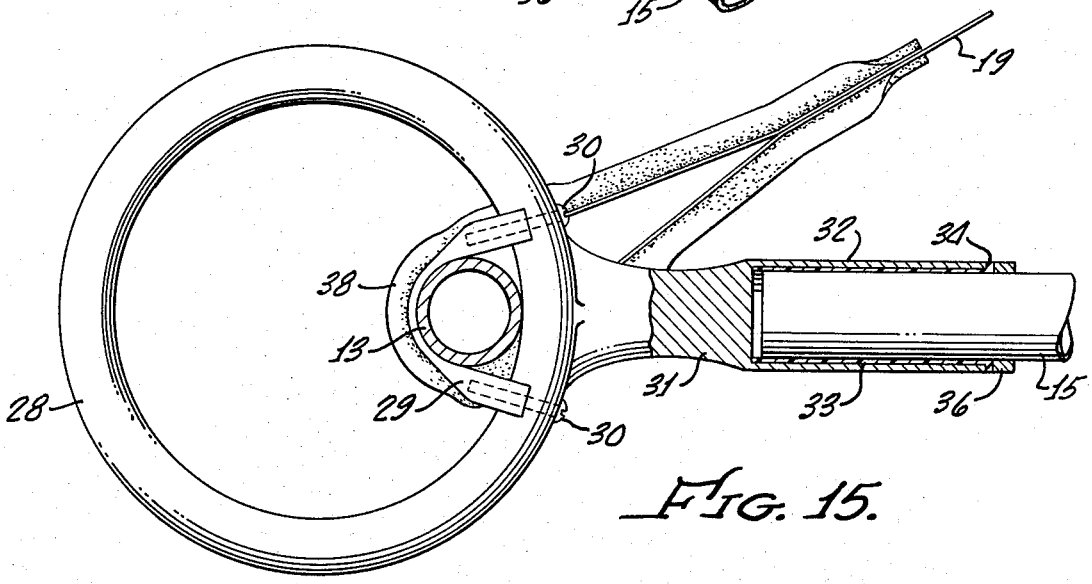
FIG. 15.

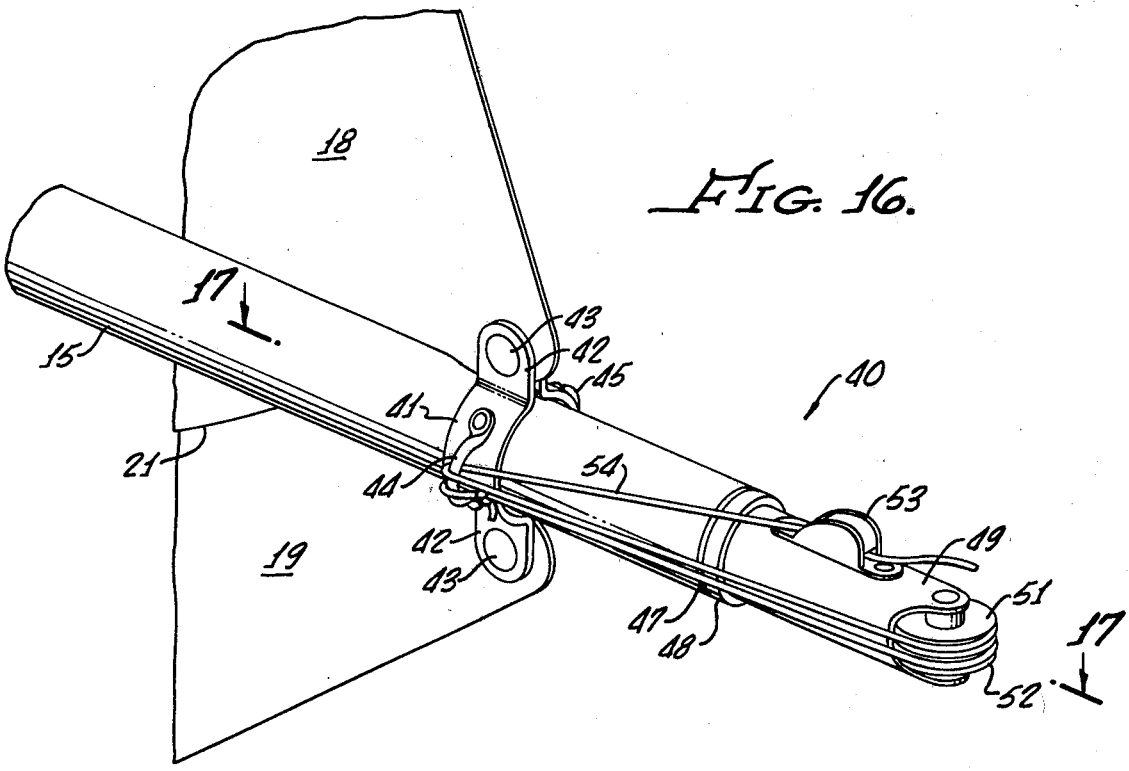
FIG. 16.
FIG. 17.
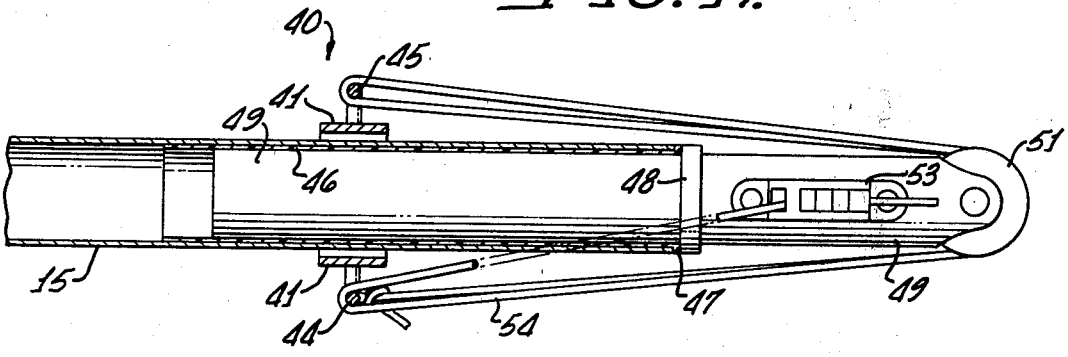

SAIL SYSTEM FOR SAILBOARDS

CROSS-REFERENCE TO RELATED APPLICATION

This application is a continuation-in-part of my copending patent application Ser. No. 289,386, filed Aug. 3, 1981 for a Sail System for Sailboards and Boardsailing Apparatus and Method.

BACKGROUND OF THE INVENTION

The vast majority of sail systems employed in the exploding field of boardsailing are characterized by two booms, one on each side of the sail. Such booms are often termed "a wishbone boom". The contruction and mounting of the wishbone boom and associated sail are such that the lee (downwind) part of the wishbone boom presses into, creases, and distorts the shape of the sail. This creasing and distortion causes air to flow such that it has a crosswise (up and down) component. The path of the air flowing along the sail is thereby lengthened, which creates extra drag without at the same time creating extra lift. Sail efficiency is therefore reduced.

Referring particularly to the leeside (downwind side) of the sail, it is emphasized that a very large portion of total sail force is created by the lower pressure on such leeside, thus the lee is extremely important and anything that disturbs airflow along such side creates a disproportionately large loss of sail efficiency. Thus, the distortion caused by the lee component of the wishbone boom, as it contacts the sail, has a distinct adverse affect on sail efficiency.

It is further emphasized that the boom has a wake, namely a turbulent area behind its leeside. Such turbulent area extends downstream for several diameters of the boom. When a boom component is placed close to the sail on the leeside thereof, as is the situation relative to the lee component of a wishbone boom, there is turbulence and consequent flow separation immediately behind the boom. Such separation combines with air separation from the leeside of the sail caused by the distorted shape thereof. The separation is greater when the sail is tilted, as is conventionally done during boardsailing, in that the boom component (on the leeside) presents a maximum surface area across the airflow.

It is also pointed out that the boom itself creates drag, and that anything that reduces the overall size of the boom reduces such drag.

SUMMARY OF THE INVENTION

In accordance with one important aspect of the present invention, there is no boom component on the leeside of the sail, there being instead only a single boom disposed on the windward side. The windward side is the most beneficial place to locate a boom, one reason being that the wake of the boom will not create flow separation (the wake being blown into the sail by the oncoming wind). The single boom on the windward side does not effect any distortion of the sail but instead permits the sail to achieve a highly efficient, aerodynamic shape-a shape characterized by the complete absence of the severe crease caused by the lee component of a wishbone boom.

In accordance with another major aspect of the present invention, the boom is shifted through the sail when the boat comes about, and relationships are created whereby there is no leakage of air through the sail in the region through which the boom shifts, or at any other region. Stated more definitely, the boom is caused to rotate through the sail, the rotation being about pivot points located near the ends of a curved boom. On both tacks, the boom curves toward the operator, who stands on the board and on the windward side of the boom.

In accordance with another major aspect of the present invention, the sail has upper and lower components, and the foot of the upper laps over the head of the lower on the windward (upwind) side. Thus, particularly since the mast is conventionally inclined toward the wind during normal sailboarding operations, the wind flows down the upper component of the sail and then onto the lower component thereof without leaking therebetween. The no-leakage relationship, with the foot of the upper sail component to windward of the head of the lower sail component, is effected automatically on both tacks, in response to rotation of the boom.

In one embodiment, the boom is straight instead of curved, and need not rotate about its axis. Thus, reduced costs of manufacture may be achieved when the cost factor is paramount.

Means, in the form of a generally vertical batten in the lower sail, are provided in order to insure that the upper edge of such sail will not droop when the winds are light.

The lower edge region of the upper sail component is curved (or otherwise extended) a substantial distance downwardly, the distance being sufficient that such lower edge region is unsupported by outhaul tension, and therefore blows against the upper edge region of the lower sail component, for enhanced sealing.

The invention relates further to the combination of the sail system with the board, to the method of sailing, to the method of rotating the boom and of achieving the no-leakage lapped relationship on both tacks, and to other important aspects.

BRIEF DESCRIPTION OF THE DRAWINGS

FIG. 1 is a perspective view of a sailboard sailing on a port tack, the wind being directed towards the rear and from the port side of the boat;

FIG. 2 is an enlarged, fragmentary elevational view of the intermediate sail portion, the view being seen from the side opposite that illustrated in FIG. 1 (namely, the view being the same as that seen by the operator shown in FIG. 1);

FIG. 13 is an isometric, fragmentary view illustrating only the forward end of the boom, the associated portion of the mast, and the associated handle;

FIG. 14 corresponds to FIG. 13, but shows the boom in a different rotated position and also illustrates adjacent sealing portions of the sail system;

FIG. 15 is a horizontal, sectional view on line 15—15 of FIG. 14;

FIG. 16 is a fragmentary, isometric view showing the outhaul means at the outer end of the boom;

FIG. 17 is a horizontal, sectional view on line 17—17 of FIG. 16;

DETAILED DESCRIPTION OF THE PREFERRED EMBODIMENTS

Referring to FIG. 1, a sailboard is shown in operating condition, on a port tack, the operator being in a balanced condition relative to the sail system. In other words, the operator is holding up the sail, while the sail is holding up the operator. The feet of the operator are then resting on the port side of the board 11 (hull), which board is prevented from moving sideways by a daggerboard the upper portion of which is shown at 12.

The sail system comprises a mast 13, the lower end of which is associated with board 11 by a universal joint 14. Joint 14 permits the mast to rotate about its longitudinal axis and, additionally, permits the sail system to drop into the water so as to prevent propulsion by the wind when the operator falls off. A line, not shown, is provided to permit the operator to retrieve the sail system from the water in order to start sailing again.

Figure 8:
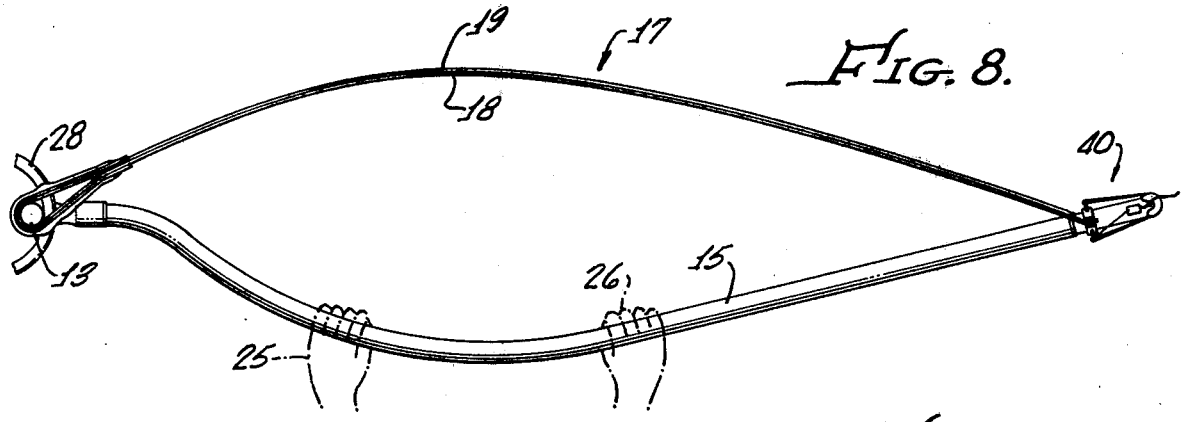
FIGS. 8 through 12, inclusive, are views corresponding, respectively, to FIGS. 3 through 7, such FIGS. 8 through 12 being what would be seen when looking downwardly from a position somewhat above the boom.
Figure 9:
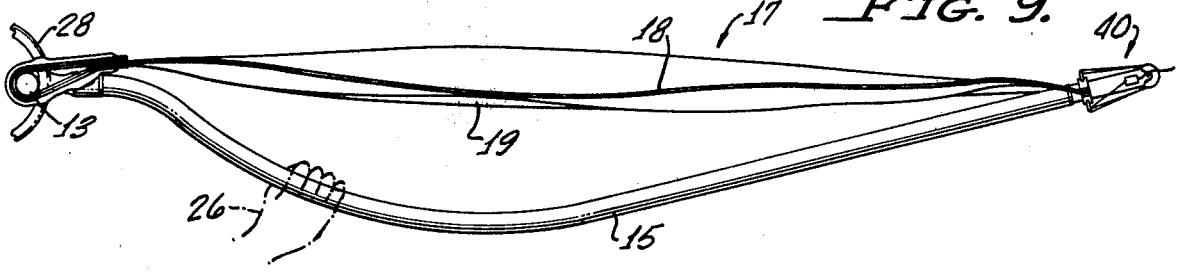

A single boom, numbered 15, is connected at its forward end to mast 13 at an intermediate elevation on the mast. Boom 15 is curved, along at least a substantial portion of the length. As shown in FIG. 8, the boom has a large portion which is generally arcuate, such arcuate portion merging with a relatively straight portion toward the boom end remote from mast 13. Boom 15 is strong, but light in weight, being preferably tubular aluminum of suitable wall thickness.

Sail means 17 are associated with mast 13 and with boom 15. The boom and the sail means are so constructed, and so associated with each other, that the boom may shift through the sail means from one side of the boat to the other side thereof. Furthermore, there is no leakage of air through the sail means while the sailboard is in sailing condition on any tack.

Sail means 17 comprises an upper sail 18 and lower sail 19, such sails overlapping each other at an elevation generally the same as that of the ends of boom 15. The luff of each sail 18 and 19 is a sleeve which is mounted around mast 13, whereas the leech of each sail is connected to the outer end of boom 15. There will be described the apparatus and method for shifting boom 15 through sail means 17, namely between the lower edge (foot) of upper sail 18 and the upper edge (head) of lower sail 19, all without permitting leakage of wind between the lapped foot and head of the sails while sailing progresses.

Boom 15 is rotatably associated with the mast 13 and is also rotatably associated with the sail portions (leech portions) remote from the mast. Thus, the boom may rotate, about an axis extending transverse to the mast and generally through or adjacent the ends of the boom, through an angle of at least 180 degrees and—very preferably—270 degrees or more. Furthermore, the foot (lower edge) of upper sail 18, which foot is numbered 21, extends downwardly in lapped relationship relative to the head of lower sail 19, such head being numbered 22. Foot 21 is curved, as best shown in FIG. 2, the curvature corresponding generally to that of boom 15 and being such that the boom may swing below foot 21 while the sailboard is coming about. As will be described subsequently, the amount of downward curving of foot 21 is sufficient to achieve an enhanced sealing relationship.

The illustrated foot 21 is shown as being stiffened by a batten 23 (FIGS. 3–5) which is curved longitudinally of the edge 21, and is sufficiently laterally flexible to permit the associated sail to bend in response to wind pressure. The foot may be otherwise suitably stiffened, if desired, as by cross-sewing of relatively stiff material or folded material. Such stiffening of foot 21 is not essential, but minimizes the tendency of the foot to flap during coming about.

Head 22 is preferably straight, not curved, as viewed in elevation (FIG. 2), it being understood that the head 22 curves laterally in response to the billowing action of the wind as shown in FIG. 1.

Particular reference will next be made to FIG. 1 and FIGS. 3 through 12, it being emphasized that FIG. 3 corresponds to FIG. 8, FIG. 4 to FIG. 9, and so forth.

Figure 10:
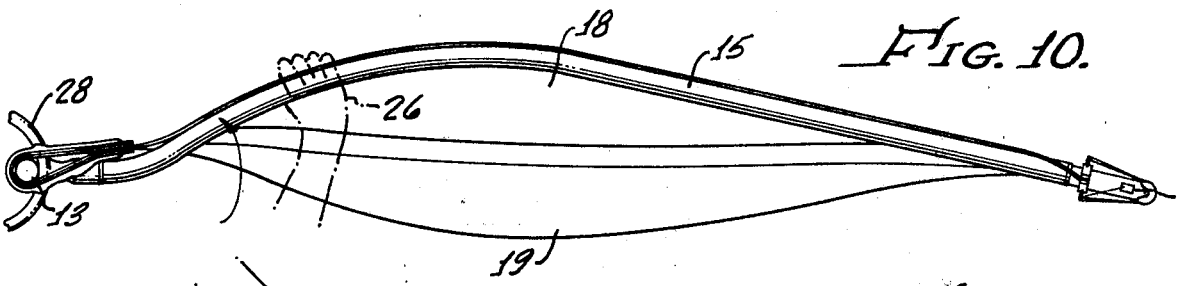

When the sailboard is sailing on the port tack, as shown in FIG. 1, the left hand 25 of the operator is forward and the right hand 26 is rearward. When the operator desires to come about, he manipulates the sail system in such a manner as to turn the board 11 into the wind, namely to port. As the boat turns into the wind, the operator must stand erect and support the mast 13 substantially vertical or else it will fall over. The operator is then standing substantially vertically on board 11, in balanced condition, instead of relying on the sail to support him. To support the mast, the operator releases his left hand 25 from the boom and grasps the mast with such left hand at a handle means described hereinafter. Substantially simultaneously, as soon as the sails 18 and 19 start to luff, the operator uses his right hand 26 to lift (pivot) boom 15 upwardly (FIGS. 4–5 and 9–10), in a sharp strong motion by which the curved region of the boom 15 strikes upper sail 18 and pushes it as shown in FIGS. 5 and 10.

It is to be remembered that, during this operation, the boat may be continuing to turn into the wind, so that the wind will "back" the sail, atempting to push the sail portions toward the port side of the boat. In fact, the above-described rotation of the boom causes backing of the sail, since the boom is pushed away from the operator. However, because the boom is then engaged with upper sail 18, and is pushing such upper sail to starboard, the backing of the sail does not permit the lower region of upper sail 18 to move to port. This is not true of lower sail 19, which sags and is then blown to port, beneath the foot 21 of upper sail 18, as shown in FIG. 5. The head of the lower sail thus shifts below the foot of the upper sail, and moves beyond the upper sail in the port direction.

Figure 6:
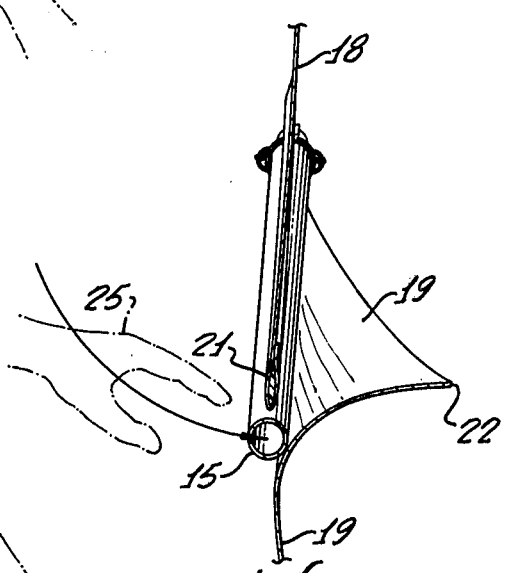
Figure 5:
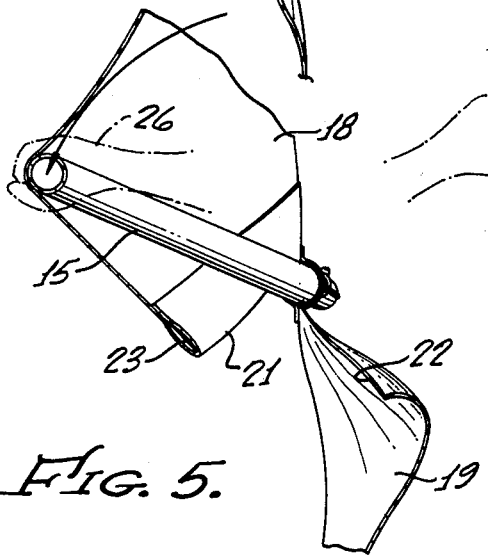
Figure 7:
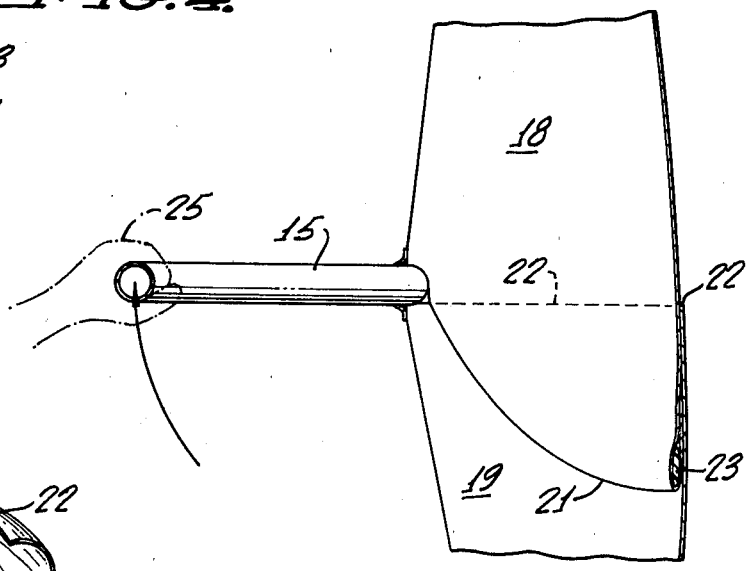
Figure 11:
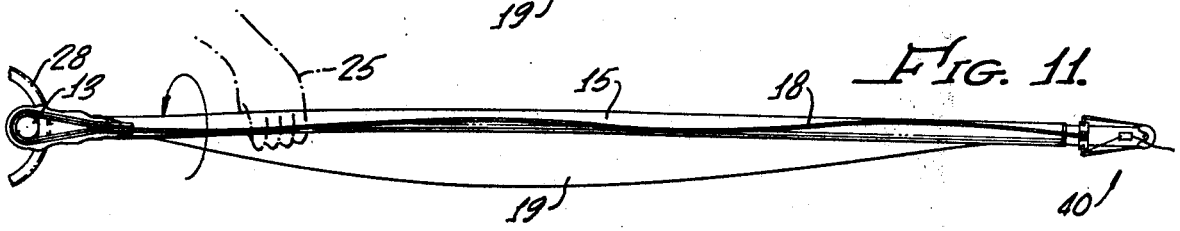
Figure 12:
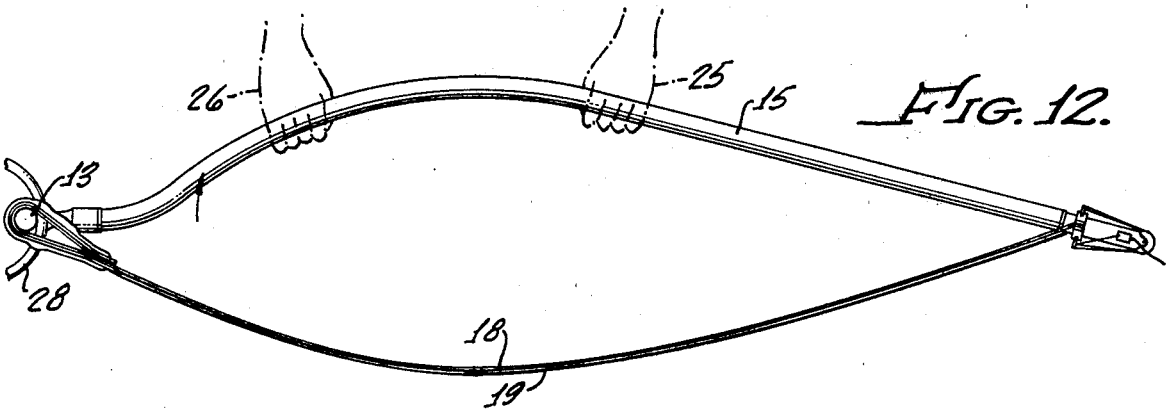
Figure 18:
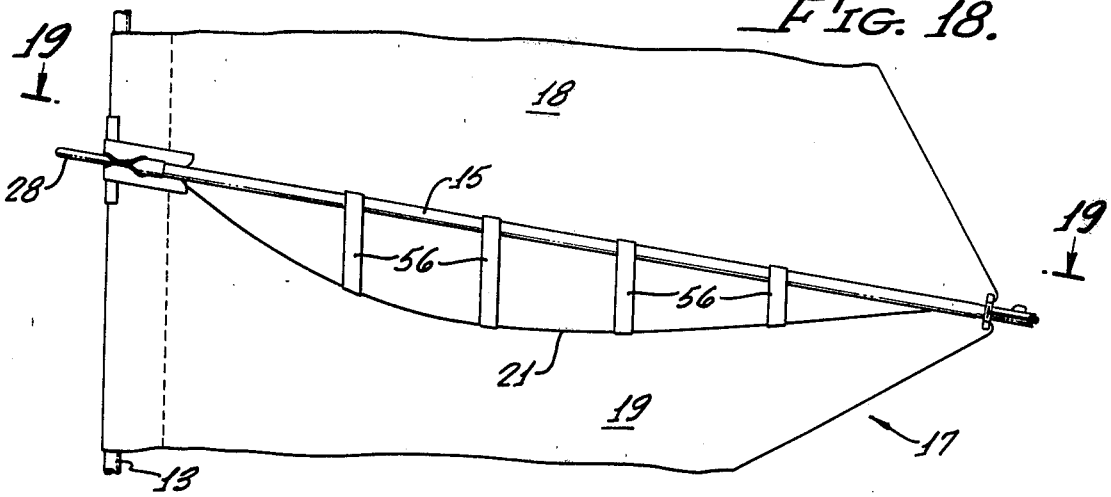
FIGS. 18 through 23, inclusive, illustrate an embodiment of the invention wherein there are connector means extending between the boom and the edge of one of the sail elements.
Figure 19:
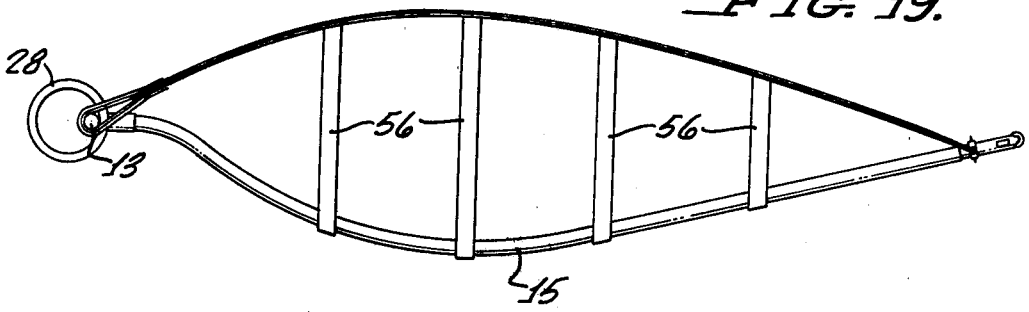

After boom 15 has pivoted upwardly sufficiently far and also around to the FIG. 5 position and somewhat therepast, the operator releases the boom so that it drops by gravity downwardly to the position of FIGS. 6 and 11. In other words, the boom is hanging in a generally vertical plane, being suspended from its ends. When thus hanging, the boom prevents the lower sail from flapping back and getting on the wrong side of the upper sail. Because of the relationship of the shape of boom 15 to that of foot 21, the boom is hanging below the foot 21 as shown in FIG. 6.

The operator next releases his left hand 25 from the mast and grasps the mast with his right hand 26, while walking around the mast forwardly thereof. He then grasps the handing boom 15 (FIGS. 6 and 11) with his left hand 25, and pivots the boom upwardly from the FIG. 6 to the FIG. 7 position, while also releasing his right hand from the mast and grasping the boom to achieve the position shown in FIG. 12. The operator 10 then pulls the boom 15 toward himself with a hard, quick pull, which fills the sails to thus achieve a fast start on the starboard tack.

The described operation occurs very rapidly, just as fast as the operator can move his hands and walk around the mast, at the appropriate time while the sails are luffing. Because of the factors described at the first portion of this specification, the sail means assumes a single, uncreased, aerodynamic shape and this, in combination with the fact that there is only one boom and it is on the windward side of the sail, creates high speed of the board through the water.

Expert sailors can vary the above-described procedure as desired. For example, it is often possible to come about without ever grasping the mast. The expert (when the boat and mast are in proper positions) rapidly "throws" the boom up and over, pirouettes about the mast, and grabs the boom on the other side of the sail.

Very importantly, there is no leakage through the region between the sails, on either tack. On both tacks, because of the above-described manually-operated means (the boom), and method, the foot of upper sail 18 is on the windward side of the head of lower sail 19, and the foot and head are lapped relative to each other. Thus, and because mast 13 is tilted toward the operator, there is a downward component of wind along the sail which flows from the upper sail 18 and then spills downwardly over the foot 21 onto lower sail 19. To leak between the sails, the wind would have to reverse direction and flow upwardly, and there is no tendency for this to occur. (If the mast were tilted in the wrong direction, namely away from the operator, it would be desirable to spill the wind from the sail since the operator would be tending to fall over forward.) Futhermore, the sails are so cut that there is a snug, engaged relationship between the lapped regions of the upper and lower sails. Preferably, the curvature (in a generally horizontal plane) of the foot of upper sail 21 is slightly greater than that of the head of lower sail 19, creating a tendency which causes the upper sail to press itself against the lower sail at the lapped regions for maximized prevention of leakage between the sails.

Referring again to FIG. 2, it is pointed out that the edge 21 curves down so far that—if the head of sail 19 were not behind it, edge 21 would flap in the wind. Thus, the curvature of edge 21 is preferably much greater than that employed on a conventional sail. In the present system, the downwardly-extended foot region of upper sail 18 is blown, by the wind, into close surface engagement with the head of sail 19, thus enhancing the seal therebetween.

The boat will still sail, though greatly less satisfactorily, if the sail edges are in incorrect positions (namely, with the upper edge of the lower sail nearest the operator.)

There will next be described the preferred form of apparatus for rotatably associating boom 15 with mast 13, particular reference being made to FIGS. 13 through 15. This comprises a combination bearing, connector, and handle element, numbered 27. The illustrated handle is a ring 28 which is mounted around mast 13, one inner portion of the ring being tightly clamped against the mast by means of a U-shaped element 29 held in place by screws 30 (FIG. 15) which extends through the ring. Thus, in the illustrated form there is such a tight clamping of the element 27 to mast 13 that movement of boom 15 from side to side effects rotation of the mast 13 about its longitudinal axis.

Ring 28 connects through a relatively thin (in vertical dimension) neck portion 31 to a bearing sleeve or socket 32. As shown in FIG. 15, sleeve 32 contains a bushing 33 having a flange 34 at the end thereof remote from the mast. The material of the bushing and flange are suitably selected to achieve the desired amount of friction, and may vary from Teflon to nylon or other suitable substance. A collar 36, which is fixedly mounted on boom 15, bears against flange 34 to prevent penetration of the boom 15 to the bottom of sleeve or socket 32. There is thus present a combined rotational and thrust bearing, in combination with the clamp means and the handle.

It is a feature of the described apparatus that, merely by loosening screws 30, the elevation of the boom relative to mast 13 may be adjusted. This is done in order to compensate for use of the craft by persons of different height, so that the boom 15 will be at the most comfortable elevation for the particular operator. The upper and lower sails 18 and 19 are moved upwardly and downwardly with the boom, there being adjustable apparatus (not shown) for connecting the upper end of the luff of the sail 18 to the top of mast 14, and there being a downhaul for connecting the lower end of the luff of sail 19 to the bottom of the mast.

Means are provided to prevent leakage of air between sails 18 and 19 at the region closely adjacent mast 13. Referring particularly to FIG. 14, these comprise sealing elements 37 and 38 respectively associated with the luff and adjacent portions of upper and lower portions of sails 18 and 19. Elements 37 and 38 are formed, preferably, of the type of foam material employed for wet suits, and have outwardly-extending, abutting flange portions which fit snugly against the upper and lower surfaces of the neck portion 31 of element 27. As shown in FIG. 14, seals are thereby created preventing air leakage between the sails relatively adjacent the mast. When the sailboard comes about, the neck 31 merely slides between the sealing elements 37 from one side of the sails to the other, the flange portions of the sealing elements permitting such sliding operation.

It is to be understood that means may be provided to effect rotation of the boom 15, about the axis extending generally through the ends thereof, by means of a crank or handle disposed forwardly of the mast and connected to the boom 15. However, it is presently preferred that no such crank or handle be provided, and that rotation of the boom be effected by direct engagement therewith by the hands of the operator 10.

Referring next to FIGS. 16 and 17, there is shown the outhaul means 40 for connecting the leeches of sails 18 and 19 to the outer end of boom 15. Such apparatus has the important advantage of permitting a change in the degree of tension on each sail, without at the same time permitting any sail to wrap around the boom.

An oversize ring 41 is mounted loosely around boom 15 and has ears or lugs 42 through which suitable fastening means 43 are provided to secure such ring to the leeches of sails 18 and 19. U-shaped connectors 44 and 45 are provided on opposite sides of ring 41, each spaced 90 degrees from the ears 42.

An elongated bushing 46, which may be formed of the same material as that of bushing 33, is extended into the outer end of boom 15. The bushing has a flange 47 at its outer end, which flange is engaged by a collar 48 which is fixedly secured to a journal element 48 telescoped into the bushing. Outwardly from collar 48, journal element 49 has two pulleys 51 and 52 at its extreme end, and has a cleat 53 on one side thereof.

A line 54 is tied at one end to connector 44, then extended around pulley 52 to connector 45, then extended around connector 45 back around pulley 51, then extended around connector 44 to the cleat 53. The described relationship permits a powerful outhaul operation to be effected, securing ring 41 in any desired position along the boom, in accordance with the wind and the desires of the operator. It is to be understood that the outhaul is not tightened sufficiently far to prevent rotation of boom 15 about its axis, during coming about, and that the curvature of boom 15 is so related to the characteristics of the sail that there will always be sufficient clearance to permit rotation of the boom through the sail. In an extreme condition, when there is a very tight condition at the outhaul 40, and the boom 15 has a relatively large curvature, the line 54 may be released or loosened temporarily when the board sailer comes about.

The line 54 may be extended through the boom, longitudinally thereof, to a cleat located near the mast. This facilitates operation of the outhaul.

The described outhaul 40 has the distinct advantage that the boom 15 rotates relative to the sails, without causing the sails to wrap therearound. The journal element 49 tends to remain relatively stationary, not rotate, being held against rotation to a substantial degree by the tension of line 54 and by the fact that there are two line portions on each side of the outhaul means.

Figure 28:
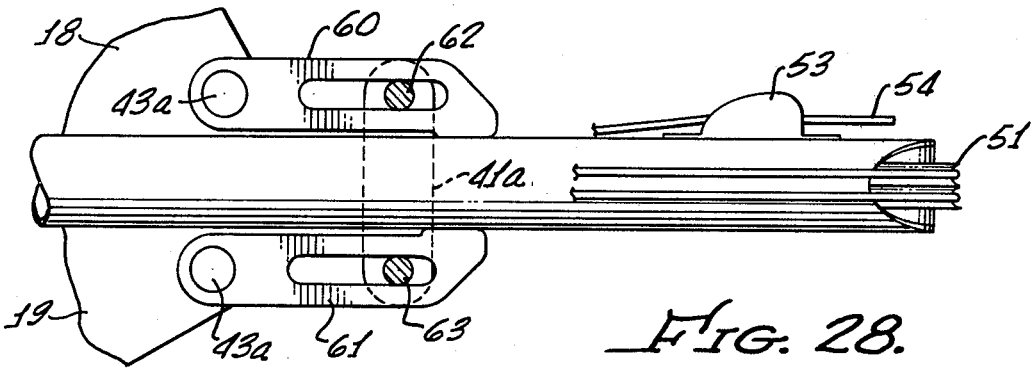
FIG. 28 illustrates an outhaul means which permits the upper and lower sail components to be so adjusted, relative to each other, as to achieve the optimum sealing relationship.

Referring next to FIG. 28 (last sheet of drawings), the construction of the outhaul is identical to that described in FIGS. 16 and 17, except as follows. Each fastening means 43*a* is not connected directly to ring 41*a*, there instead being interposed separate slotted connectors 60 and 61. Threaded fasteners 62 and 63, having suitable lockwashers, are employed to connect connectors 60 and 61 to the ring 41*a*. Thus, by loosening (and then re-tightening) one or both fasteners 62 and 63, the positions of the two fastening means 43*a*, relative to each other, may be adjusted longitudinally of the boom. Such adjustment is effected to cause optimized, surface, sealing engagement between the head and foot regions of the sails when line 54 is tightened and the craft is sailing.

There have been described above various surprising and unexpected results, including (without limitation) the automatic prevention of leakage between the sails, the cooperation between the boom and sails in such manner as to reverse the position of the boom while achieving correct positioning of the sails, etc. A further surprising and unexpected result is that the frictional resistance of the boom 15 to rotation about the axis through the ends thereof varies in proportion to the force of the wind and the position of the sail. Thus, when the boat is coming about, and the sails are luffing, there is no tension in the sails and consequently no compressive (column) force on the boom and associated bearing means. The collar 48 is then no pressing against flange 47 (FIG. 17) nor is collar 36 pressing against flange 34 (FIG. 15). Thus, the boom 15 can rotate with the desired degree of freedom, as determined by the characteristics of the material forming the bushings surrounding the boom ends. However, when the boat is sailing on either tack, and the wind is strong, the tension in the sails creates a very substantial compressive (column) load in the boom 15, forcing the collars against the associated flanges and thus creating substantially increased friction tending to prevent rotation of the boom about its axis extending through the ends of the boom. This prevents the boom from flapping about in an undesired manner, particularly when the wind is strong.

EMBODIMENT OF FIGS. 18 THROUGH 23

In accordance with the present embodiment, fail-safe means are provided to ensure that the edges of the sails are in the correct, lapped relationship at all times, even in the event of some highly unusual wind, wave, or other conditions which might otherwise tend to disturb the correct relationship.

Means are provided to connect the boom 15 to the edge of the one of the sails, namely to the lower edge (foot) of upper sail 18. In the illustrated embodiment, there are four straps, each an endless loop, and each numbered 56. The lengths of the straps depend upon the positions where they are located along the boom, and means (not shown) may be provided to prevent any movement, longitudinally of the boom, of the strap ends contacting the same.

Figure 3:
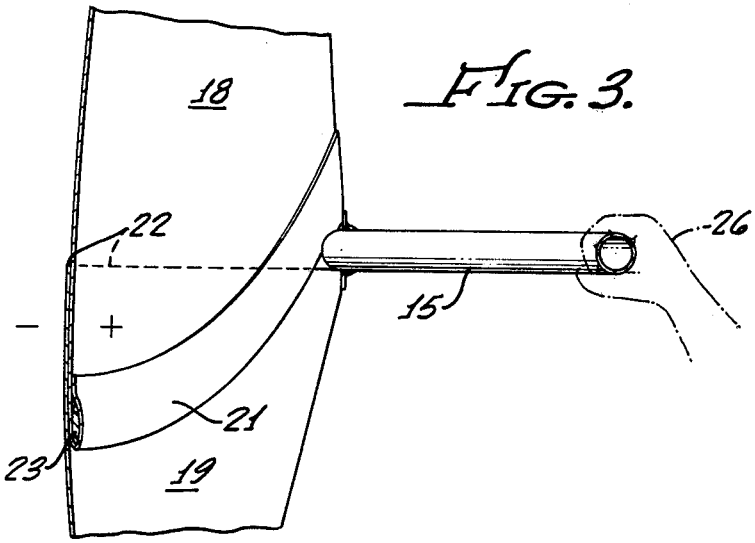
FIGS. 3 through 7, inclusive, are fragmentary sectional views illustrating the boom and the overlapped sail portions, and showing how rotation of the boom creates the desired lapped relationship on either tack, each of the views being what would be seen by a viewer looking rearwardly in FIG. 1 from a position just in advance of the left hand of the illustrated operator.
Figure 4:
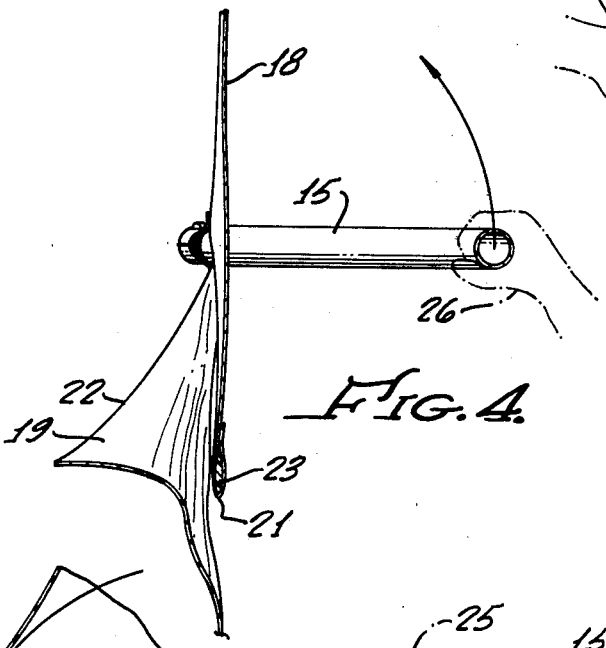
Figure 20:
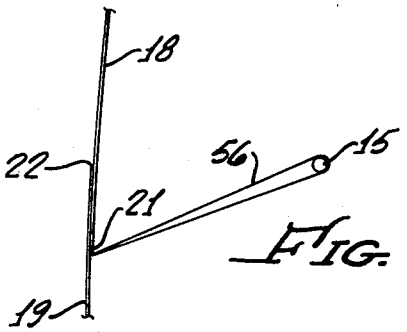
Figure 22:
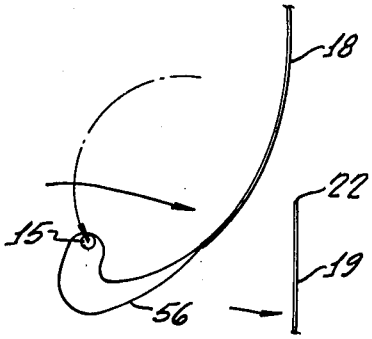
Figure 21:
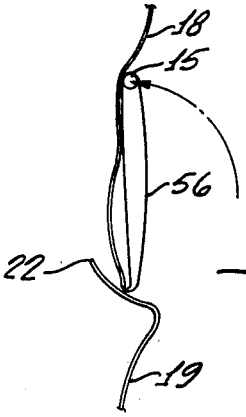
Figure 23:
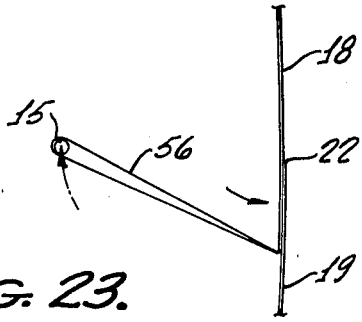

Referring to FIG. 20, which corresponds to FIG. 3 except that one of the straps 56 is shown, the relationship is shown during which the board is sailing on the port tack. When the operator 10 decides to come about, he follows the same procedure described above relative to FIGS. 3 through 12, inclusive, starting by pivoting boom 15 upwardly until it engages upper sail 18. This relationship is shown in FIG. 21. Then, when the boom drops downwardly, as indicated in FIG. 22, the straps 56 provide additional barriers preventing the upper edge 22 (head) of lower sail 19 from moving backward beneath the upper sail. Thus, both during coming about and when the board is sailing on either tack (the port tack represented by FIG. 20, or the starboard tack represented by FIG. 23), the upper edge (head) 22 of lower sail 19 will not be able to move upwardly on the wrong side (namely, the windward or upwind side) of upper sail 18.

EMBODIMENT OF FIGS. 24 THROUGH 27

Except as specifically stated, the embodiment of FIGS. 24 through 27 is identical to that described relative to FIGS. 1 through 17 and 28.

The boom 70 of the present embodiment is straight, not curved. The use of a straight boom reduces costs in that it eliminates the need for bearings. It also reduces, somewhat, the amount of aluminum required for the boom. A further benefit is achieved, in light winds, in that the operator can hold the sail somewhat closer to his body with a straight boom than he can with a curved boom, thus permitting the boat to sail slightly closer to the wind. Furthermore, when the boom is straight, it is not necessary to teach a beginner how to rotate the boom.

On the other hand, the advantages of a curved, rotatable boom are great. Primarily, the advantage is that control of overlapping is effected positively and automatically, even when the sails are flapping (which often occurs when a beginner is sailing the boat). An expert is far better able, than is a beginner, to sail with a straight boom since the expert can often compensate for the tendency of the sails to flap during coming about. It will be recalled that, as described relative to FIGS. 3 through 7, that the downwardly-hanging boom (FIG. 6) prevents the upper region of lower sail 19 from flapping back to incorrect position.

In heavy winds, the curved boom permits the operator to extend his body further away from the sail, thus increasing the righting torque necessary to compensate for the heavy wind.

The degree of curvature of the boom may be adjusted as desired, and (particularly when cost factors are paramount) the boom may be straight instead of curved. It is also possible to employ two booms relative to the same set of sails, one boom for heavy winds and one for light winds. The booms are readily interchangeable.

Figure 24:
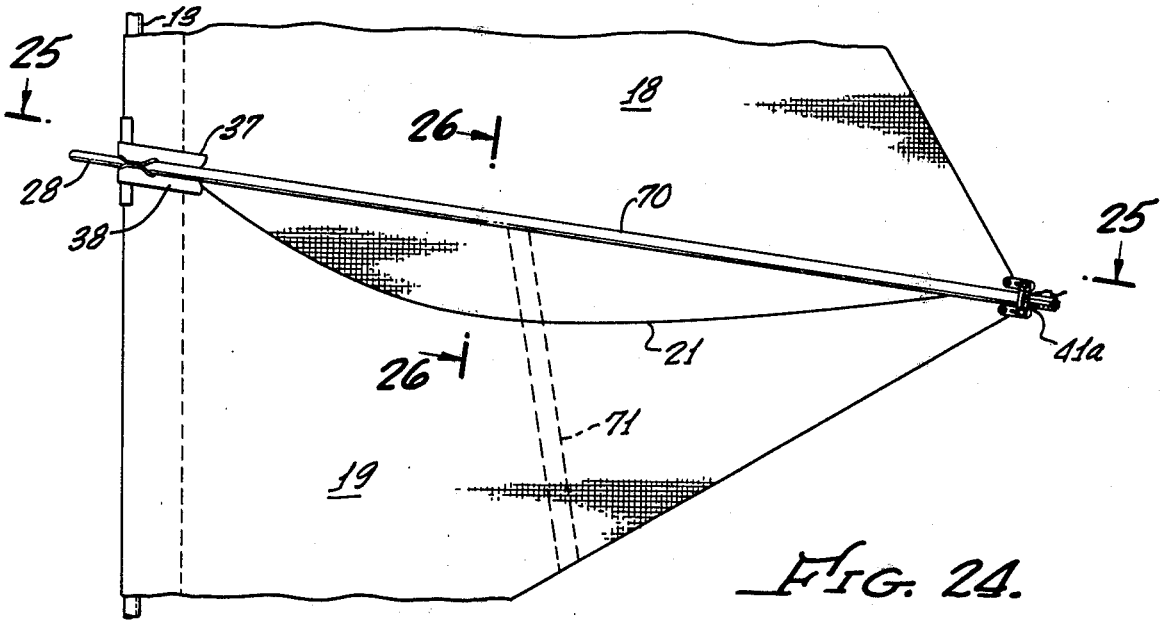
FIGS. 24 through 27, inclusive, illustrate an embodiment wherein the boom is straight, and a batten is mounted in the lower sail component.
Figure 25:
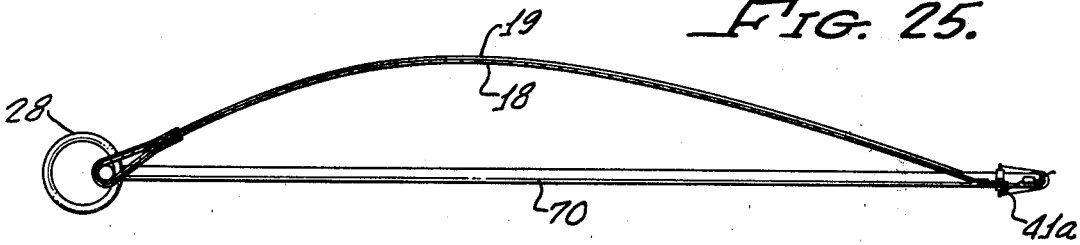
Figure 26:
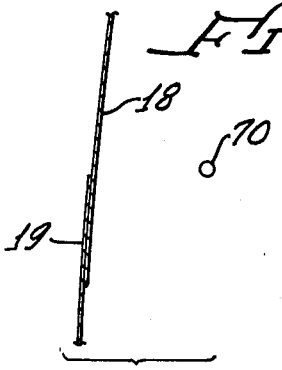
Figure 27:
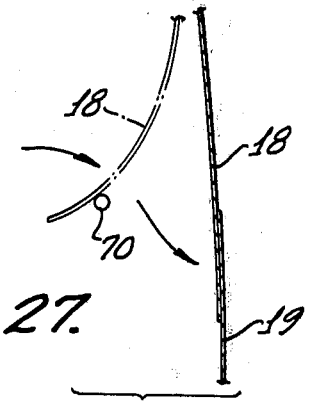

Referring to FIG. 24, and to FIG. 25, which is a horizontal section—looking downwardly—taken on line 24–25 of FIG. 24, it will be seen that the boat is illustrated as being on the port tack. The operator (not shown) is standing on the board, on the side of straight boom 70 remote from the sail components 18 and 19. As is greatly preferred, the foot of upper sail 18 is closer to the operator than is the head of lower sail 19. The described relationship is also shown in FIG. 26, which is a vertical section on line 26—26 of FIG. 24, looking rearwardly.

When the operator desires to come about, he manipulates the sail system in such manner as to turn the craft into the wind. He also pushes the boom away from his body, so as to cause backing of the sail. The wind on the back side of the sail will then blow lower sail 19 below boom 70, from the position shown in FIG. 26 to that shown in FIG. 27. The upper sail 18 will drag on boom 70, as shown in phantom lines in FIG. 27, and therefore will be blown to the FIG. 27 (solid lines) position after the lower sail 19 will be blown thereto. Therefore, as is desired, the foot of upper sail 18 will be closer to the operator than will the head of lower sail 19. However, as indicated above, the straight boom does not provide compensation for flapping of the sails.

The connector means, described relative to the embodiment of FIGS. 18 through 23, may also be employed with the embodiment of FIGS. 24 through 27. Thus, the straight boom 70 is connected to the lower edge of upper sail 18, by straps such as are shown at 56 in the embodiment of FIGS. 18 through 23.

In FIG. 24, a generally vertical batten 71 is illustrated as mounted in the lower sail 19, extending to the upper edge of such sail. Batten 71 may be provided in the lower sail of all embodiments described in this application. The use of such batten 71 is presently preferred when the winds are light, because it prevents the upper edge (head edge 22, FIG. 2) of lower sail 19 from drooping or sagging during sailing under light-wind conditions. The batten 71 is removable, and may be removed when the winds are medium or heavy.

It is pointed out that, when the winds are light and there is no batten, the head edge of lower sail 19 tends to sag, but this condition immediately corrects itself when the winds pick up. The head edge of the lower sail then elevates due to billowing of the lower sail, and the correct surface-engagement seal between the overlapped sail edges is effectively maintained.

It is emphasized that the amount of outhaul tension and the outhaul position are so controlled that the adjacent edges of the upper and lower sails are spaced a substantial distance away from the boom (even when the boom is straight, as shown in FIG. 25)—free from interference from the boom—so that the composite sail is free to achieve at optimum aerodynamic shape and a high ratio of lift to drag.

The foregoing detailed description is to be clearly understood as given by way of illustration and example only, the spirit and scope of this invention being limited solely by the appended claims.

I claim:

1. A sail system for a sailboard of the type in which an operator rides the board in standing position, and manipulates a sail system in order to effect propulsion of the board, said sail system comprising:

(a) a mast adapted at its lower end to be mounted on a sailboard, (b) a boom connected at one end to said mast at a region intermediate the upper and lower ends thereof, said boom extending away from said mast transversely thereof, (c) upper and lower sails each having its luff connected to said mast and its leech connected to said boom at the end of said boom remote from said mast, said upper sail being generally above said boom, said lower sail being generally below said boom, said sails and boom being such that said boom may be grasped by the operator regardless of which side of said sails said operator is standing on, and (d) means to effect a lapped, sealing relationship between the lower edge of said upper sail and the upper edge of said lower sail, said sealing relationship being such that said lower edge of said upper sail is, regardless of the tack said sailboard is on, on the upwind side of said upper edge of said lower sail, said sail system being such that said sails operate like a single sail which is aerodynamically unconstrained by any boom and therefore assumes a single efficient sailing shape characterized by the absence of a crease, said sail system being further characterized by the absence of substantial leakage of air between said sails, which leakage would reduce the efficiency of the sail system.

2. The invention as claimed in claim 1, in which said sails are so shaped and mounted that said lapped edges are in surface engagement with each other at substantially all times except when the sailboard is coming out.

3. The invention as claimed in claim 2, in which there is no physical connection between said lapped edges at regions intermediate said mast and said boom end remote from said mast, said lapped and engaged relationship being effected by wind power only.

4. The invention as claimed in claim 1, in which the lapped edges of said upper and lower sails are on the upwind side of said boom on either tack.

5. The invention as claimed in claim 4, in which neither of the lapped edges is connected to said boom except (a) near or by said mast, and (b) at said bottom end remote from said mast.

6. The invention as claimed in claim 4, in which means are provided to effect loose connection between said lower edge of said upper sail, and said boom, at at least one region intermediate said mast and said boom end remote from said mast.

7. The invention as claimed in claim 6, in which said loose connection is effected by elongated strap means.

8. A single-boom sail system for sailboats of the type in which an operator stands on the board and manually manipulates the sail system to effect wind propulstion of the board, said single-boom sail system having two separate sails which are caused to operate as a single sail unconstrained or creased by any boom element, the simulated single sail thus assuming a highly efficient aerodynamic shape, said sail system comprising:

(a) a mast the lower end of which is adapted to be pivotally mounted on a board, (b) a boom one end of which is connected to an intermediate portion of said mast, said boom extending away from said mast transversely thereof, (c) an upper sail the luff of which is connected to said mast above said boom, and the leech of which is connected to the outer end of said boom, said upper sail having a lower edge the elevation of which is generally the same as that of said boom, and (d) a lower sail the luff of which is connected to said mast below said boom, and the leech of which is connected to the outer end of said boom, said lower sail having an upper edge the elevation of which is generally the same as that of said boom, said lower edge and said upper edge being, at regions intermediate the luffs and leeches of said sails, on the downward side of said boom on either tack and spaced away from said boom on either tack, whereby the operator may readily grasp said boom, on either tack, while standing on the upwind side of said boom, (e) characterized in that means are provided to effect an air seal between said lower edges, on either tack, so as to prevent substantial air leakage therebetween.

9. The invention as claimed in claim 8, in which said sealing means operate in the absence of any connection between said upper and lower edges, except at said mast and at the bottom end remote from said mast.

10. The invention as claimed in claim 9, in which said upper and lower edges are lapped relative to each other, on either tack, and are in surface engagement with each other.

11. The invention as claimed in claim 9, in which said boom is rotatable about an axis extending transverse to said mast, and in which said rotatable boom further constitutes manually-operated means to effect, automatically, a condition such that such lower edge of said upper sail is, on either tack, upwind of said upper edge of said lower sail.

12. A sail system for sailboats, characterized by the presence of a single boom which is rotated through the sail means, during coming about, so that the boom is on the upwind side of the sail means on either tack and is readily grasped by an operator standing on the board upwind of both the boom and the sail means, and so that the sail means never engages any boom element, except during coming about, and therefore can assme an efficient, uncreased, aerodynamic shape, said said system comprising:

(a) a mast, (b) a single boom, (c) sail means extending above and below said boom, the luff of said sail means being connected to said mast, and the leech of said sail means being connected to said boom at the boom end remote from said mast, (d) means to rotatably connect one end of said boom to said mast at an intermediate portion thereof, and to rotatably connect the other end of said boom to said sail means at a region remote from said mast, whereby said boom may be rotated about an axis which is generally parallel to a line extending through the ends of said boom, said boom and said sail means being so constructed that regions of said boom intermediate said boom ends may pass through said sail means when said boom is rotated about said axis while the sailboard is coming about, and (e) means for preventing substantial leakage of air through said sail means.

13. The invention as claimed in claim 12, in which said sail means comprise two sails one of which is generally above said boom and the other of which is generally below it.

14. The invention as claimed in claim 13, in which means are provided to prevent leakage of air between said sail means except when the sailboard is coming about.

15. The invention as claimed in claim 12, in which said boom is curved.

16. The invention as claimed in claim 12, in which said boom is arcuate near the mast, as relatively straight remote therefrom.

17. The invention as claimed in claim 16, in which said boom is generally arcuate for at least a substantial portion of its length.

18. The invention as defined in any one of claims 1 through 17, in which said sail system is combined with a board, and in which the lower end of said mast is pivotally connected to said board for pivotal movement in substantially any direction, so that when the operator does not manually support said mast said sail system will fall over and movement of the sailboard will stop.

19. A method of sailing a sailboard, which comprises:

(a) providing a sailboard having its mast pivotally connected to the board for pivotal movement in substantially any direction, and having a curved boom one end of which is rotatably connected to said mast for rotation of the boom about an axis extending generally through the ends of said boom, and having upper and lower sail portions the luffs of which are connected to said mast respectively above and below said boom, and the leeches of which are connected to said boom at a point remote from said mast, said sail portions being so shaped that the adjacent edges of said upper and lower sail portions overlap each other, (b) sailing said sailboard on a port tack, with the upper edge of said lower sail portion on the starboard side of the lower edge of said upper sail portion, with said boom on the port side of both of said edges, with the operator on the port side of said boom, and with said mast inclined toward the operator whereby wind moves down said upper sail portion and then onto said lower sail portion without leaking between said sail portions, (c) commencing a coming-about operation by manipulating said boom to cause said board to turn to port, into the wind, (d) rotating said boom upwardly and at least 180° degrees about said axis, and substantially simultaneously walking around said mast forwardly of said boom, said boom rotation causing said boom to rotate between said upper and lower sail portions, while said boom simultaneously pushes on said lower edge of said upper sail portion, and while said upper edge of said lower sail portion blows below said lower edge, (e) grasping said boom after said walking around said mast and then beginning to sail said board on a starboard tack, the operator then standing on the starboard side of said boom, and said upper edge being on the port side of said lower edge.

20. The invention as claimed in claim 19, in which said boom is thus rotated about 270 degrees, and then is rotated in the reverse direction about 90 degrees to thereby achieve a net rotation of about 180 degrees.

21. A method of sailing a sailboard, which comprises:

(a) providing a sailboard having upper and lower sail portions, the lower edge of said upper sail portion and the upper edge of said lower portion being lapped, and having a boom adapted to be grasped by the operator regardless of which tack the sailboard is on, (b) sailing said sailboard on a port tack with said sail edges in such relationship to each other that said lower edge is on the port side of said upper edge whereby wind moving down said upper sail portion flows onto said lower sail portion without passing in substantial amount between said lapped edges, (c) turning said sailboard to port, into the wind, (d) walking around the mast of said sailboard and also grasping said boom from the side of the board opposite the one said boom was originally grasped from, and (e) reversing the lapped relationship of said edges whereby the lower edge of said upper sail portion is on the starbard side of said upper edge of said lower sail portion, and (f) sailing said boat on the starbord tack whereby wind moving down said upper sail portion flows onto said lower sail portion without passing in substantial amount between said lapped edges.

22. The invention as claimed in claim 21, in which said edges of said sail portions are in surface engagement with each other while the sailboard is sailing on either tack.

23. A sail system for a sailboard of the type in which an operator sails in standing position, and manipulates a sail system in order to effect propulsion of the sailboard by the wind, said sail system comprising:

(a) a mast adapted to be associated with a board in such relationship that the mast may pivot downwardly into the water when the sail is dropped by the operator, (b) a boom extending outwardly from said mast, (c) an upper sail disposed generally above said boom, the luff of said upper sail being associated with said mast and the leech of said upper sail being connected to the end portion of said boom, (d) a lower sail disposed generally beneath said boom, the luff of said lower sail being associated with said mast and the leech of said lower sail being connected to said end portion of said boom, and (e) means to loose-connect an edge portion of at least one of said upper and lower sails, at an edge thereof relatively adjacent said boom, to said boom in such manner that when the boom is manipulated to change from one tack to the other a predetermined desired orientation will be achieved between the edges of said sails which are relatively adjacent said boom, said edges at regions intermediate the luffs and leeches at said sails being spaced from said boom on either tack, said predetermined desired orientation being such that the lower edge of the upper sail is always upwind of the upper edge of said lower sail, the two edges being in lapped contacting relationship relative to each other.

24. The invention as claimed in claim 23, in which said connecting means are straps.

25. The invention as claimed in claim 23, in which said connecting means connect only the lower edge of said upper sail to said boom.

26. A sail system for a sailboard of the type in which an operator rides the board in standing position, and manipulates the sail system in order to effect wind propulsion of the board, said sail system comprising:

(a) a mast adapted at its lower end to be mounted on a sailboard, (b) a generally bowed boom extending transversely from said mast at an intermediate portion thereof, one end of said boom being rotatably associated with said mast, (c) an upper sail the luff of which is connected to said mast above said boom and the leech of which is connected to the end of said boom remote from said mast, said upper sail having a curved lower edge which curves downwardly in a direction away from said mast and then curves upwardly in a direction toward the end of said boom remote from said mast, (d) a lower sail the luff of which is connected to said mast below said boom and the leech of which is connected to said end of said boom remote from said mast, and said lower sail having an upper edge disposed at a sufficiently high elevation to be in lapped relationship to said curved lower edge of said upper sail.

27. The invention as claimed in claim 26, in which the curvature of said bowed boom is greater than that of said lower edge of said upper sail, whereby when said bowed boom is pivoted to a downward position it will clear said lower edge of said upper sail.

28. The invention as claimed in claim 26, in which at least one of said edges of said sail adjacent said boom is provided with stiffening means.

29. The invention as claimed in claim 26, in which means are provided to effect loose connection between said boom and the adjacent edge of said upper sail.

30. The invention as claimed in claim 26, in which said curved lower edge curves downwardly sufficiently far that such edge would flap if not supported by the lower sail, whereby the lower edge region of said upper sail blows against the lower sail and seals therewith.

31. The invention as claimed in claim 26, in which means are provided to effect a sealing relationship between the end of said boom relatively adjacent said mast and the sail regions at areas adjacent said boom and also said mast, whereby to prevent leakage between the sails at said region.

32. The invention as claimed in claim 26, in which said sail system is combined with a sailboard, there being a pivotal connection between the lower end of said mast and a region of said board such that when the operator drops the sail system it falls into the water and causes propulsion of the sailboard to cease.

33. A single-boom sail system for sailboards of the type in which an operator stands on the board and manually manipulates the sail system to effect wind propulsion of the board, said single-boom sail system having two separate sails which are caused to operate as a single sail unconstrained or creased by any boom element, the simulated single sail thus assuming a highly efficient aerodynamic shape, said sail system comprising:

(a) a mast the lower end of which is adapted to be pivotally mounted on a board, (b) a boom one end of which is connected to an intermediate portion of said mast, said boom extending away from said mast transversely thereof, (c) an upper sail the luff of which is connected to said mast above said boom, and the leech of which is connected to the outer end of said boom, said upper sail having a lower edge the elevation of which is generally the same as that of said boom, and (d) a lower sail the luff of which is connected to said mast below said boom, and the leech of which is connected to the outer end of said boom, said lower sail having an upper edge the elevation of which is generally the same as that of said boom, said lower edge and said upper edge being on the downwind side of said boom, and spaced from said boom, on either tack, whereby the operator may readily grasp said boom, on either tack, while standing on the upwind side of said boom, (e) characterized in that said lower edge and upper edge are in lapped relationship to each other, and are adjacent each other, on either tack, and further characterized in that neither of said edges is close-connected to said boom except at the ends of said edges.

34. The invention as claimed in claim 33, in which neither of said edges is connected, at all, to said boom except at the ends of said edges.

35. The invention as claimed in either of claims 33 and 34, in which said sail system is combined with a sailboard.

36. A method of sailing a sailboard, which comprises:

(a) providing a sailboard having upper and lower sail portions, the lower edge of said upper sail portion and the upper edge of sail lower portion being lapped, and having a boom adapted to be grasped by the operator regardless of which tack the sailboard is on, (b) sailing said sailboard on a port tack with said sail edges in such relationship to each other that said lower edge is on the port side of said upper edge whereby wind moving down said upper sail portion flows onto said lower sail portion without passing in substantial amount between said lapped edges, (c) turning said sailboard to port, into the wind, (d) preventing said upper sail portion from being blown past said boom until after said lower portion has blown therepast, thus causing said lower edge to be on the starboard side of said upper edge, (e) walking around the mast of said sailboard and also grasping said boom from the side of the board opposite the one said boom was originally grasped from, and (f) sailing said boat on the starboard tack whereby wind moving down said upper portion flows onto said lower sail portion without passing in substantial amount in between said lapped edges.

37. The invention as claimed in claim 36, in which said prevention of blowing of said upper sail portion past said boom until said lower sail portion has blown therepast is effected by causing said upper sail portion to drag on said boom.

38. A single-boom sail system for sailboards of the type in which an operator stands on the board and manually manipulates the said system to effect wind propulsion of the board, said single-boom sail system having two separate sails which are caused to operate as a single sail unconstrained or creased by any boom element, the simulated single sail thus assuming a highly efficient aerodynamic shape, said sail system comprising:

(a) a mast the lower end of which is adapted to be pivotally mounted on a board, (b) a boom one end of which is connected to an intermediate portion of said mast, said boom extending away from said mast transversely thereof, (c) an upper sail the luff of which is connected to said mast above said boom, and the leech of which is connected to the outer end of said boom, said upper sail having a lower edge the elevation of which is generally the same as that of said boom, and (d) a lower sail the luff of which is connected to said mast below said boom, and the leech of which is connected to the outer end of said boom, said lower sail having an upper edge the elevation of which is generally the same as that of said boom, said lower edge and said upper edge being on the downwind side of said boom on either tack, whereby the operator may readily grasp said boom, on either tack, while standing on the upwind side of said boom, and (e) means provided in said lower sail to maintain the upper edge thereof in lapped relationship to the lower edge of said upper sail even under light-wind conditions.

39. The invention as claimed in claim 38, in which said means is a batten provided in said lower sail and extending upwardly to the vicinity of the upper edge thereof.

40. The invention as claimed in either of claims 38 and 39, in which said sail system is combined with a sailboard.

41. A single-boom sail system for sailboards of the type in which an operator stands on the board and manually manipulates the sail system to effect wind propulsion of the board, said single-boom sail system having two separate sails which are caused to operate as a single sail unconstrained or creased by any boom element, the simulated single sail thus assuming a highly efficient aerodynamic shape, said sail system comprising:

(a) a mast the lower end of which is adapted to be pivotally mounted on a board, (b) a boom one end of which is connected to an intermediate portion of said mast,
said boom extending away from said mast transversely thereof, (c) an upper sail the luff of which is connected to said mast above said boom, and the leech of which is connected to the outer end of said boom,
said upper sail having a lower edge the elevation of which is generally the same as that of said boom, and (d) a lower sail the luff of which is connected to said mast below said boom, and the leech of which is connected to the outer end of said boom,
said lower sail having an upper edge the elevation of which is generally the same as that of said boom, said lower and upper edges of said sails being lapped relative to each other, said lower edge and said upper edge being on the downwind side of said boom on either tack, whereby the operator may readily grasp said boom, on either tack, while standing on the upwind said of said boom, and (e) differential outhaul means provided at the outer end of said boom and providing the means by which the leeches of said upper sail and lower sail are connected to said outer end of said boom, said differential outhaul means being adapted to permit independent adjustment of the tensions on said upper sail and lower sail whereby to cause the lapped edges thereof to be in surface engagement with each other for achievement of an effective seal.

42. The invention as claimed in claim 41, in which said differential outhaul includes a single element adapted to be shifted to different portions of the end of said boom, and maintain at such positions, and further comprises independently-adjustable means to connect such element to the leeches of said upper sail and said lower sail.

43. A single-boom sail system for sailboards of the type in which an operator stands on the board and manually manipulates the sail system to effect wind propulsion of the board, said single-boom sail system having two separate sails which are caused to operate as a single sail unconstrained or creased by any boom element, the simulated single sail thus assuming a highly efficient aerodynamic shape, said sail system comprising:

(a) a mast the lower end of which is adapted to be pivotally mounted on a board, (b) a boom one end of which is connected to an intermediate portion of said mast,
said boom extending away from said mast transversely thereof, said boom being straight, (c) an upper sail the luff of which is connected to said mast above said boom, and the leech of which is connected to the outer end of said boom,
said upper sail having a lower edge the elevation of which is generally the same as that of said boom, and (d) a lower sail the luff of which is connected to said mast below said boom, and the leech of which is connected to the outer end of said boom,
said lower sail having an upper edge the elevation of which is generally the same as that of said boom, said lower edge and said upper edge being on the downwind side of said boom on either tack, whereby the operator may readily grasp said boom, on either tack, while standing on the upwind side of said boom, (e) characterized in that said lower edge and upper edge are in lapped relationship to each other, and are adjacent each other, on either tack, and further characterized in that neither of said edges is close-connected to said boom except at the ends of said edges.

44. The invention as claimed in claim 43, in which neither of said edges is connected, at all, to said boom except at the ends of said edges.

45. The invention as claimed in either of claims 43 and 44, in which said sail system is combined with a sailboard.

46. The invention as claimed in claim 43, in which the lower edge of said upper sail extends downwardly a distance sufficiently far that said lower edge will drag on said boom when the sailboard is coming about, and in which the upper edge of said lower sail does not extend upwardly sufficiently far to cause substantial dragging on said upper edge on said boom, whereby said lower sail will blow beneath said boom before said upper sail blows thereabove, the result being that the lower edge of said upper sail will be on the upwind side of the upper edge of sail lower sail.

47. A single-boom sail system for sailboards of the type in which an operator stands on the board and manually manipulates the said system to effect wind propulsion of the board, said single-boom sail system having two separate sails which are caused to operate as a single sail unconstrained or creased by any boom element, the simulated single sail thus assuming a highly efficient aerodynamic shape, said sail system comprising:

(a) a mast the lower end of which is adapted to be pivotally mounted on a board, (b) a boom one end of which is connected to an intermediate portion of said mast,
said boom extending away from said mast transversely thereof, (c) an upper sail the luff of which is connected to said mast above said boom, and the leech of which is connected to the outer end of said boom, said upper sail having a lower edge the elevation of which is generally the same as that of said boom, and (d) a lower sail the luff of which is connected to said mast below said boom, and the leech of which is connected to the outer end of said boom,
said lower sail having an upper edge the elevation of which is generally the same as that of said boom, said lower edge and said upper edge being on the downwind side of said boom on either tack, whereby the operator may readily grasp said boom, on either tack, while standing on the upwind side of said boom, (e) characterized in that said lower edge and said upper edge are lapped relative to each other, and are spaced from said boom, on either tack, and further characterized in that neither of said edges is close-connected to said boom at regions intermediate said luffs and leeches.

48. The invention as claimed in claim 47, in which neither of said edges is connected, at all, to said boom except at the ends of said edges.

49. The invention as claimed in either of claims 47 and 48, in which said sail system is combined with a sailboard.

50. A single-boom sail system for sailboards of the type in which an operator stands on the board and manually manipulates the sail system to effect wind propulsion of the board, comprising:

(a) a mast the lower end of which is adapted to be mounted on a board, (b) a boom one end of which is connected to an intermediate portion of said mast, said boom extending away from said mast transversely thereof, (c) an upper sail the luff of which is connected to said mast above said boom, and the leech of which is connected to the outer end of said boom, (d) a lower sail the luff of which is connected to said mast below said boom, and the leech of which is connected to the outer end of said boom, said upper and lower sails having, respectively, lower and upper edges in lapped relationship to each other, said lapped lower edge and upper edge being on the downwind side of said boom on either tack, (e) characterized in that said lower sail and upper sail, including the lapped edges thereof, are so shaped and disposed as to operate substantially as a single sail unconstrained or creased by any boom element, to achieve advantages including enhanced aerodynamic efficiency.

51. The invention as claimed in claim 50, in which said boom is curved and is rotatably connected to said mast for rotation about a generally horizontal axis, and in which said boom and said sail edges are so shaped and mounted that intermediate portions of said boom can be manually rotated between said sail edges when the sailboard comes about.

52. A method of sailing a sailboard, which comprises:

(a) providing a sailboard having its mast pivotally connected to the board for pivotal movement in substantially any direction, and having a boom so shaped that upon rotation of said boom, about an axis generally parallel thereto, at least a substantial portion of the boom will shift laterally a substantial distance, and having first and second sails respectively above and below said boom, the luffs of said sails being connected to said mast and the leeches of said sails being connected to said boom at a point remote from said mast, (b) causing the lower edge of said first sail, and the upper edge of said second sail, to be in lapped relationship to each other, so that said sails cooperate with each other to simulate a single large sail, (c) sailing said sailboard on a port tack, with said substantial portion of said boom on the port side of and spaced from said sail means, while standing on the board at the port side of said substantial portion of said boom, (d) commencing a coming-about operation by manipulating said boom to cause said board to turn to port, into the wind, (e) rotating said boom about said axis generally parallel thereto, in such manner that said substantial portion of said boom shifts laterally, between said edges of said first and second sails, (f) substantially simultaneously moving to the starboard side of said substantial portion of said boom, and (g) grasping said substantial portion of said boom and beginning to sail said sailboard on a starboard tack, while standing at the starboard side of said substantial portion of said boom, said sails then being on the port side of, and spaced from, said substantial portion of said boom.

53. The invention as claimed in claim 52, in which said step of rotating said boom is so effected as to cause, on both tacks, said lower edge to be on the windward side of said upper edge.

* * * * *

UNITED STATES PATENT AND TRADEMARK OFFICE

CERTIFICATE OF CORRECTION

PATENT NO. : 4,365,570

DATED : Dec. 28, 1982

INVENTOR(S) : Robert S. Jamieson

It is certified that error appears in the above-identified patent and that said Letters Patent are hereby corrected as shown below:

Column 5, line 8, "handing" should read ---hanging---.

Column 7, line 11, "48" should read ---49---.

Column 8, line 2, "no" should read ---not---.

In claim 8, column 11, line 33, "downward" should read ---downwind---.

Signed and Sealed this

*Third* Day of *May 1983*

[SEAL]

*Attest:*

GERALD J. MOSSINGHOFF

*Attesting Officer*

*Commissioner of Patents and Trademarks*